US008701632B2

(12) United States Patent
Solferino et al.

(10) Patent No.: US 8,701,632 B2
(45) Date of Patent: Apr. 22, 2014

(54) FUEL INJECTOR MOUNT

(75) Inventors: Vince P. Solferino, Dearborn, MI (US); Paul W. Zeng, Inkster, MI (US); Patrick C. Brostrom, Livonia, MI (US); Michael R. Kaput, Canton, MI (US); Scott Lehto, Walled Lake, MI (US); Syed M. Ahmed, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 58 days.

(21) Appl. No.: 13/556,355

(22) Filed: Jul. 24, 2012

(65) Prior Publication Data

US 2014/0027543 A1 Jan. 30, 2014

(51) Int. Cl.
*F02M 61/14* (2006.01)

(52) U.S. Cl.
CPC ..... *F02M 61/14* (2013.01); *F02M 2200/8023* (2013.01); *F02M 2200/853* (2013.01); *F02M 2200/856* (2013.01)
USPC ..... 123/470

(58) Field of Classification Search
CPC ..... F02M 61/14; F02M 2200/853; F02M 2200/856; F02M 2200/8023
USPC ..... 123/470
See application file for complete search history.

(56) References Cited

U.S. PATENT DOCUMENTS

| | | | | | |
|---|---|---|---|---|---|
| 5,035,224 | A * | 7/1991 | Hornby et al. | ..... | 123/470 |
| 5,040,512 | A * | 8/1991 | Twilton | ..... | 123/470 |
| 5,044,338 | A * | 9/1991 | Shelton | ..... | 123/469 |
| 5,074,269 | A * | 12/1991 | Herbon et al. | ..... | 123/470 |
| 5,136,999 | A * | 8/1992 | Bassler et al. | ..... | 123/470 |
| 5,146,896 | A * | 9/1992 | Imoehl et al. | ..... | 123/470 |
| 5,167,213 | A * | 12/1992 | Bassler et al. | ..... | 123/470 |
| 5,803,052 | A * | 9/1998 | Lorraine et al. | ..... | 123/470 |
| 5,901,688 | A * | 5/1999 | Balsdon et al. | ..... | 123/516 |
| 5,909,725 | A * | 6/1999 | Balsdon et al. | ..... | 123/516 |
| 6,053,149 | A * | 4/2000 | Lorraine | ..... | 123/470 |
| 6,340,019 | B1 | 1/2002 | Eshleman et al. | | |
| 6,481,420 | B1 * | 11/2002 | Panasuk et al. | ..... | 123/470 |
| 6,668,803 | B1 * | 12/2003 | McClean et al. | ..... | 123/470 |
| 6,705,292 | B2 * | 3/2004 | Bugos | ..... | 123/470 |
| 6,748,925 | B1 * | 6/2004 | De Vulpillieres et al. | .... | 123/470 |
| 7,159,570 | B2 * | 1/2007 | Zdroik | ..... | 123/470 |
| 7,334,571 | B1 * | 2/2008 | Beardmore | ..... | 123/470 |
| 7,360,524 | B2 * | 4/2008 | Zdroik et al. | ..... | 123/470 |
| 7,527,038 | B2 | 5/2009 | Watanabe et al. | | |
| 7,540,273 | B2 * | 6/2009 | Scheffel et al. | ..... | 123/470 |
| 7,556,022 | B1 * | 7/2009 | Doherty et al. | ..... | 123/470 |
| 7,802,560 | B2 * | 9/2010 | Lysinger et al. | ..... | 123/470 |
| 7,856,962 | B2 * | 12/2010 | Harvey et al. | ..... | 123/470 |
| 8,479,710 | B2 * | 7/2013 | Davis | ..... | 123/470 |
| 2005/0161025 | A1 * | 7/2005 | Braun et al. | ..... | 123/470 |
| 2009/0084358 | A1 * | 4/2009 | Zdroik | ..... | 123/470 |
| 2010/0012093 | A1 | 1/2010 | Pepperine et al. | | |

* cited by examiner

*Primary Examiner* — Thomas Moulis
(74) *Attorney, Agent, or Firm* — James Dottavio; MacMillan, Sobanski & Todd, LLC

(57) ABSTRACT

A direct fuel injection fuel system includes a fuel rail cap and a fuel injector received within the fuel rail cap. A clip extends through slots in the fuel rail cap and engages the fuel rail to support the fuel rail within the fuel rail cap. The fuel rail cap includes a groove adjoining the slots to accept a portion of the clip. The clip engages a shoulder on the fuel injector assembly. The shoulder may be on the injector body or on an adapter secured to the injector body.

12 Claims, 4 Drawing Sheets

FUEL INJECTOR MOUNT

FILED OF THE INVENTION

The present invention relates to internal combustion engine fuel injection systems, and more particularly to the mounting of fuel injectors.

BACKGROUND OF THE INVENTION

Direct injection is a common type of fuel injection system in which fuel is injected directly into the combustion chambers of an internal combustion engine cylinder by fuel injectors. The fuel injectors are connected to a fuel supply by a fuel rail, typically a tubular member The fuel injectors typically are mounted in fuel injector sockets in the fuel rail. Fuel rails in direct injection fuel systems are commonly mounted on the engine's cylinder head or engine block, with the fuel injectors also mounted on or resting on or in direct contact with the cylinder head or engine block.

A typical fuel injector has a nozzle which extends through the cylinder head for fluid communication with a combustion chamber. A seal is mounted on the nozzle and seals the nozzle against the cylinder head to block combustion gases. The seal moves with the nozzle in the event of movement between the nozzle and the cylinder head bore in which the nozzle is positioned. Such movement may be caused by vibrations of the fuel injector as will be described.

Direct injection fuel rails experience significantly higher fuel pressures than other types of fuel injection systems. High-pressure fuel pumps used in these systems commonly create pressure pulsations that can cause the fuel rail and the fuel injectors to pulsate or vibrate. This can cause wear and create undesirable noise, especially noticeable at idle speeds. Vibration also has been known to cause premature wearing of the injector seals between the injector nozzles and the cylinder head.

Forces originating from the structure of a fuel injector can also cause undesirable noise and wear. Energizing of the magnetic solenoid valve in the injector and the impact of the pin seating at injector closing can create a hammering effect which can cause component wear. Fuel injector noise can also be transmitted to the cylinder, and from there to other engine components such as the oil pan, front cover, cam cover, and intake manifold.

Attempts to alleviate noise and wear problems have included designs for suspending fuel injectors from the fuel rail, but such attempts have been complicated and not flexible enough to be used with various injector designs. A simple and flexible design for suspending a fuel injector from a fuel rail is needed which can support relatively high fuel pressure and combustion pressure loads.

SUMMARY OF THE INVENTION

The present invention is a fuel injector assembly comprising a fuel rail cap and a fuel rail received within the fuel rail cap. A clip extends through the fuel rail cap and engages the fuel rail to secure the fuel rail within the fuel rail cap. Preferably, the clip has a "C" shape and the fuel rail cap includes slots circumferentially spaced generally 180 degrees from each other so that the legs of the clip extend through the slots. The fuel rail cap may include a groove joining the slots to secure an intermediate portion of the clip. The clip may engage a flange on the injector body or on an adapter secured to the injector body.

DESCRIPTION OF PREFERRED EMBODIMENTS

Figure 1:
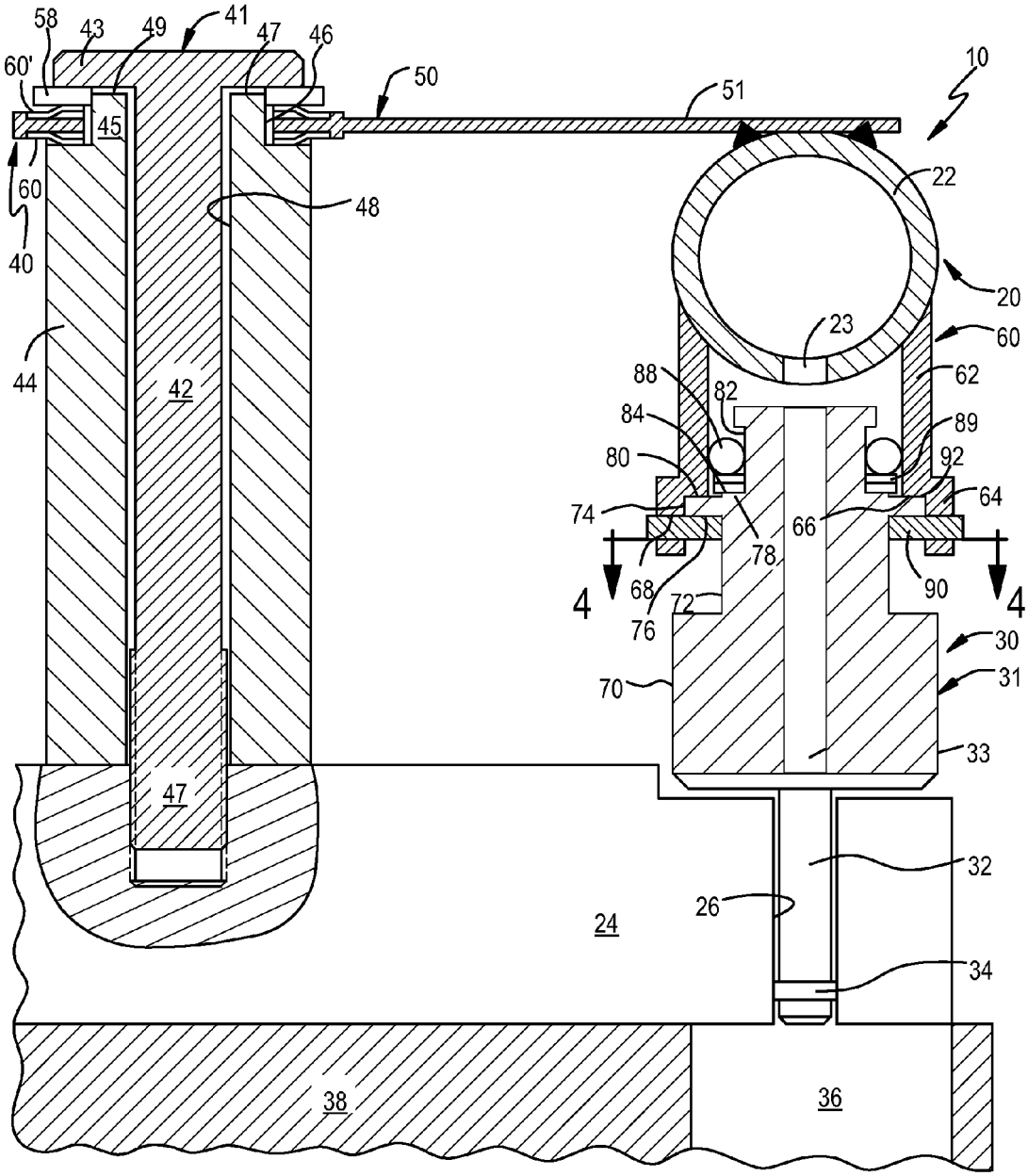
FIG. 1 is a cross-sectional view of a first embodiment of a fuel injector mounting system in accordance with the present invention.

Referring to FIG. 1, a direct injection fuel injector system 10 includes a fuel rail assembly 20 and a fuel rail 22 having at least one fuel injector cap 60. The fuel rail cap 60 is welded or otherwise secured to the fuel rail 22. A fuel injector 30 is supported within the fuel rail cap 60. The injector 30 is an assembly including a main body 31 and a nozzle 32. The injector 30 is suspended over an internal combustion engine cylinder head 24.

In FIG. 1, the injector 30 is positioned vertically above the cylinder head 24, but other configurations are within the scope of the present invention. For example, injectors may be positioned horizontally and mounted in the engine block 38 adjacent the combustion chamber 36. In addition, injectors may be mounted at an angle to horizontal or vertical for engines having cylinders oriented in a "V" configuration. Therefore, as used herein, the term "suspended" means that the injector body 31 does not directly contact the cylinder head 24 or engine block 38.

The fuel rail 22 includes a fuel passageway 23 in communication with an injector fuel passageway 33. The injector nozzle 32 extends into the bore 26 in the cylinder head 24 to provide fluid communication with a combustion chamber 36 in the engine block 38. An annular seal 34 fits snuggly around the nozzle 32 and sealingly engages the bore 26 to seal the combustion chamber 36. The seal 34 may experience limited axial sliding relative to the bore 26.

The fuel rail 22 is welded to an arm 51 of a fuel rail bracket 50 which supports the fuel rail assembly. Stainless steel is a preferred material for the fuel rail 22, the cap 60, and the bracket 50, but other materials and attachment methods may be used as well.

The fuel rail assembly is mechanically mounted on the cylinder head 24 with a shock absorbing mounting assembly 40. The mounting assembly 40 includes a fastener in the form of a mounting bolt 41 having a head 43, a shaft 42, and a threaded end 47 opposite the head 43. In a preferred embodiment, the bolt 41 is a standard M8 bolt having a shaft diameter of approximately 7.7 millimeters, but other sizes may be preferred depending on the engine, the size and weight of the fuel rail assembly 20, etc. In addition, other types of fasteners may be used, such as a screw, rivet, etc.

The bolt shaft 42 extends through a cylindrical mounting sleeve 44 and is threaded into the cylinder head 24. The sleeve 44 positions the fuel rail assembly 20 at a desired height. A cylindrical opening 48 in the sleeve 44 is slightly larger than the bolt shaft diameter to allow a small radial clearance therebetween, forming an annular gap. Of course, the sleeve 44, opening 48, and bolt shaft 42 can have other cross-sectional shapes, such as square.

The upper end of the mounting sleeve 44 includes a reduced diameter flange 45 for aligning the stacked mounting assembly components. Together, the sleeve 44, flange 45, and bolt head 43 define an annular channel 46. A small annular gap 47 is defined by the top surface 49 of the flange 45 and the bolt head 43. The bracket 50, a pair of isolator washers 60, 60', and a washer 58 are stacked in the channel 46. The illustrated flange 45 and apertures in the bracket 50, isolator washers 60, 60' and washer 58 are cylindrical, but other shapes are possible, such as a square shape.

Figure 1A:
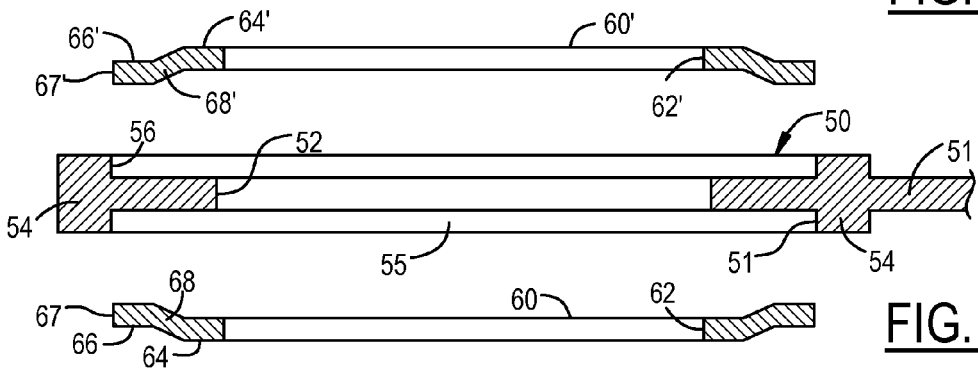
FIG. 1*a* is an exploded cross-sectional view of a portion of the fuel rail mounting assembly of FIG. 1.

Referring to FIG. 1*a*, the fuel rail mounting bracket 50 has a aperture 52 that fits around the sleeve flange 45. The bracket 50 includes an annular flange 54 that defines two opposing annular pockets 55 defined by annular walls 56. Pockets 55 provide seats for the isolator washers 60, 60'.

Isolator washers 60, 60' are stainless steel for compatibility with bracket 50, but other materials, such as plastics, may be acceptable as well. Isolator washers 60, 60' have a stepped configuration. Each isolator washer 60, 60' has a cylindrical center aperture 62, 62', respectively, with a diameter substantially the same as that of the bracket aperture 52, about 8.2 millimeters in one preferred embodiment. The bracket aperture 52 and isolator washer apertures 62, 62' are slightly larger than the outer diameter of the flange 46, thereby leaving a small annular gap therebetween. Contact of the isolator washers 60, 60' with the sleeve flange 45 could alter the stiffness and reduce effectiveness of the isolator washers 60, 60', and therefore is preferably avoided. While the preferred embodiment includes two isolator washers 60, 60', a single isolator washer may be used in certain applications.

Each isolator washer 60, 60' has a generally planar inner annular portion 64, 64' which respectively define the apertures 62, 62', and a generally planar outer annular portion 66, 66'. Frusto-conical intermediate portions 68, 68' connect the inner and outer portions of the isolator washers 60, 60'.

The illustrated isolator washers 60, 60' are identical but are reversed or flipped relative to each other to engage the bracket 50, washer 58 and sleeve 44. The annular outer portion 66, 66' of each isolator washer is seated in a bracket pocket 55. The diameter of the outer peripheral annular walls 67, 67' of the isolator washers 60, 60' is about 15.5 millimeters in one preferred embodiment. The diameter of each pockets 55 is_slightly larger than that of the isolator washers 60, 60' to allow limited radial expansion of the isolator washers 60, 60' within the pockets 55.

Referring again to FIG. 1, the bracket inner annular portions 64, 64' contact the flange 44 and washer 58, respectively, but do not contact the bracket 50. Washer 58 is positioned between the bolt head 43 and the top isolator washer 60'. The washer 58 may have an outer diameter less than that of the isolator washers 60, 60' because it engages only the inner annular portion 64' of the top isolator washer 60'. Washer 58 can be steel and does not need to be compatible with the isolator washer material. Washer 58 protects the top isolator washer 60' from damage during the torque-down procedure. However, as will be apparent to those skilled in the art, the washer 58 may not be necessary in certain applications.

During assembly, the bottom isolator washer 60 is positioned around the flange 45. Next, the bracket 50 is positioned around the flange 45, followed by the top isolator washer 60'. Washer 58 is then positioned on the bolt shaft 42 adjacent the head 43. The bolt 41 is then inserted into the sleeve 44 and threaded into the cylinder head 24 to the extent that the isolator washers 60, 60' are compressed to a desired degree, as measured by a torque wrench, to lock the bracket 50 in place. This compression can create a preload of about 800 Newtons in a preferred embodiment, but the amount of compression could range from about 500 to 1500 Newtons or more, depending on the particular fuel rail to be supported. After compression, the isolator washers 60, 60' serve as lock washers to prevent the bolt 41 from backing out of the threaded hole in the cylinder head 24.

The isolator washers 60, 60' provide a tunable stiffness to the mounting assembly that allows for calculation and more control over vibration frequencies. The isolator washer intermediate portions 68, 68' deflect to absorb any desired compression. The clamping forces exerted on the bracket 50 by the isolator washers 60, 60' can readily be calibrated because the deflection of the isolator washers 60, 60' can be controlled. Radial expansion of the isolator washers 60, 60' under compression is minimal.

In a preferred embodiment, the metal thickness of each of the inner, outer and intermediate portions of the isolator washers 60, 60' is about 1.3 millimeters, while the total prestressed axial thickness of each of the isolator washers 60, 60' is about 1.5 millimeters. After loading, the total thickness of each isolator washer 60, 60' could be reduced to about 1.4 millimeters.

The height of the sleeve flange 45 is such that the desired compression level of the isolator washers 60, 60' will be reached before the bolt head 43 bottoms out on the top surface 49 of the flange 45. Alternatively, the height of the flange 45 could be calculated to allow optimum compression when the bolt head 43 bottoms out against the top surface 49 of the flange 45. This would allow threading of the bolt 40 without determining a compression level with a torque wrench. However, this method may require precise calculations for each different engine or fuel rail assembly design, as opposed to using a torque wrench setting which may be more consistent for most engine or fuel rail designs.

When preloaded, the frusto-conical shaped intermediate sections 68, 68' of the isolator washers 60, 60' deform, thereby acting as a spring. Adequate spring stiffness can be designed to reduce unwanted high frequency force transmitted to the cylinder head 24 at idle conditions. When the engine is running at speeds other than idle, dynamic loads applied by the fuel rail 22 will increase, which will cause the isolator washers 60, 60' to compress further and become more rigid to limit fuel rail vibration. This also limits movement and increases durability of the injector seals 34. Isolator stiffness and maximum compression or displacement can be controlled by the metal thickness, total height, conical shape, and diameters of the isolator washers 60, 60'.

The fuel injector cap 60 includes an upper portion 62 attached to the fuel rail 22 and a lower portion 64. The illustrated upper portion 62 and the lower portion 64 are generally cylindrical and co-axial, but other configurations are possible. The walls of the cap portions 62 and 64 define an internal downwardly facing annular shoulder 66.

Figure 2:
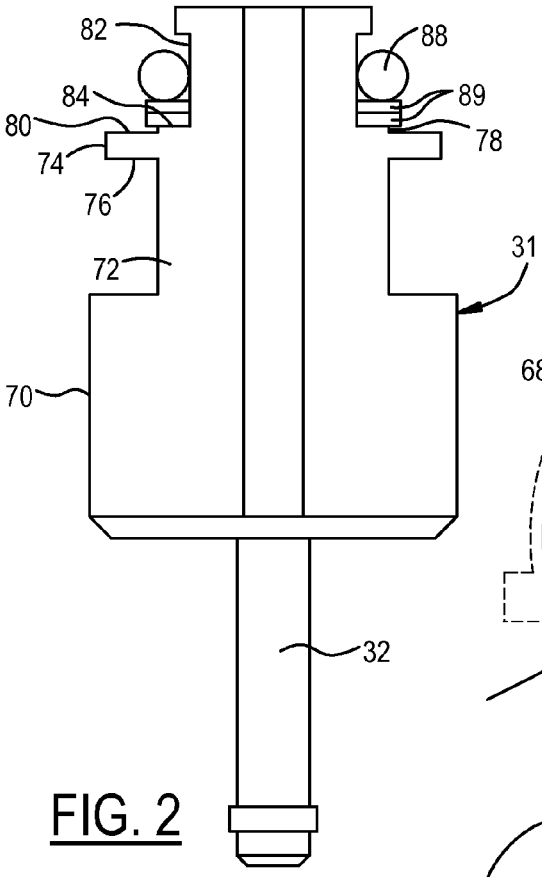
FIG. 2 is a plan view of the fuel injector of FIG. 1.

Referring also to FIG. 2, the illustrated injector body 31 is generally cylindrical with a series of varying diameter steps. Injector body 31 includes a lower body section 70 and a reduced diameter intermediate section 72. An enlarged diameter section 74 forms a flange and provides a downwardly facing annular external shoulder 76. Another reduced diameter section 78 provides an upwardly facing annular shoulder 80 on the flange 74. Reduced diameter section 82 provides a washer seat 84. The injector body 31 is sealed in the cap 60 with an O-ring 88 which engages the outer surface of injector section 82 and the inner surface of the cap portion 62. The O-ring 88 rests on two stacked washers 89, the bottom washer being supported on the seat 84. The injector 30 is supported within the fuel rail cap 60 by a clip 90 which extends through slots in the lower cap portion 64 as will be described herein.

Figure 4:
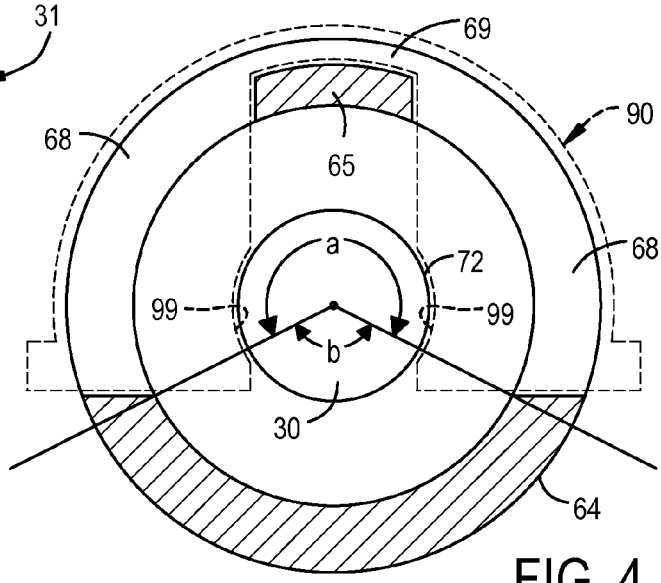
FIG. 4 is a cross-sectional view of a portion of the fuel injector taken along line 4-4 of FIG. 1.
Figure 3:
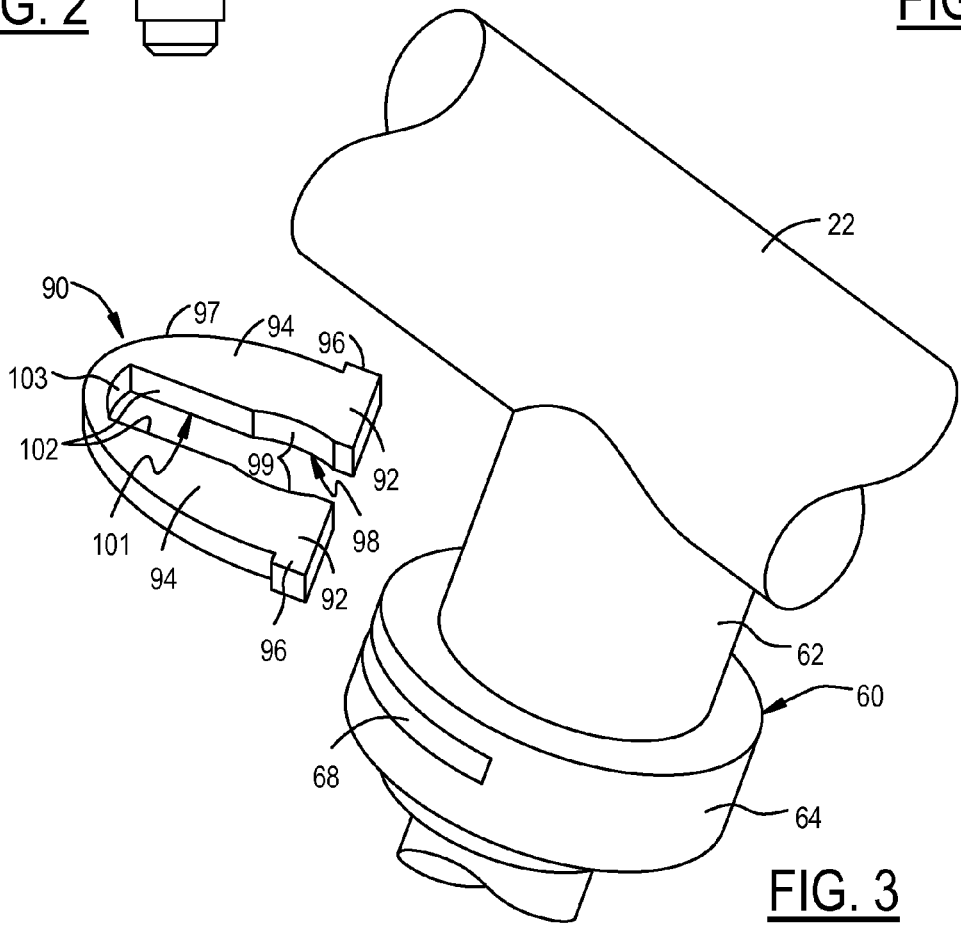
FIG. 3 is an exploded perspective view of a portion of the fuel injector mounting system of FIG. 1.

Referring to FIGS. 3 and 4, the injector cap 60 includes two slots 68 which extend radially completely through opposite sides of the cylindrical lower portion 64. The slots 68 are generally circumferentially spaced 180 degrees from each other. A groove 69 joins the two slots 68. The groove 68 extends radially through only a portion of the wall of lower portion 64, leaving the lower portion 64 with an ungrooved section 65 to assure structural integrity. Together, the groove 69 and slots 68 extend an angle "a" of approximately 220 degrees around the lower portion 64, leaving an ungrooved and unslotted portion of the lower section 64 extending an angle "b" of about 140 degrees for structural integrity of the injector cap lower portion 64.

A clip 90 (shown in phantom in FIG. 4) has a generally "C" shape with two legs 94. Feet 96 extend generally radially outwardly from the circumferential ends of the legs 94, respectively. Clip 90 fits into the injector cap slots 68 and groove 69. The clip feet 96 may aid in insertion and removal of the clip 90.

The clip 90 has an arcuate outer periphery 97 and a slotted inner periphery 98. The inner periphery 98 includes two opposed arcuate walls 99. The arcuate clip walls 99 have a radius substantially the same as that of injector surface 72 and may be in contact with the injector surface 72 for maximum supporting contact with the shoulder 76 on the flange 74. Referring again to FIG. 1, upper surfaces 92 of the clip legs 94 engage the downwardly facing injector shoulder 76 of injector flange 74, while the downwardly facing cap shoulder 66 engages the upwardly facing injector shoulder 80 of injector flange 74 to lock the injector 30 in place.

The inner periphery 98 of the clip 90 further includes a notch 101 with parallel walls 102 joined by an arcuate wall 103. The arcuate wall 103 has a radius similar to that of the lower cap portion groove 69. The purpose of the clip notch 101 is to allow the clip 90 fit into groove 69 formed around the unslotted portion 65 of the cap lower portion 64. This allows the clip 90 to encompass approximately 220 degrees of the periphery of the lower cap portion 64 without unduly weakening the cap.

As used herein, the term "clip" is intended to encompass devices in addition to those illustrated, such as pins, wedges, etc. While the illustrated embodiment of the present invention includes a one-piece clip 90, other configurations are possible, such as two separate clips, one on each side of the fuel injector cap, or possibly even a single clip. Such alternatives could allow greater structural integrity of the fuel injector cap if required for certain engine or fuel injector assembly designs.

Figure 5:
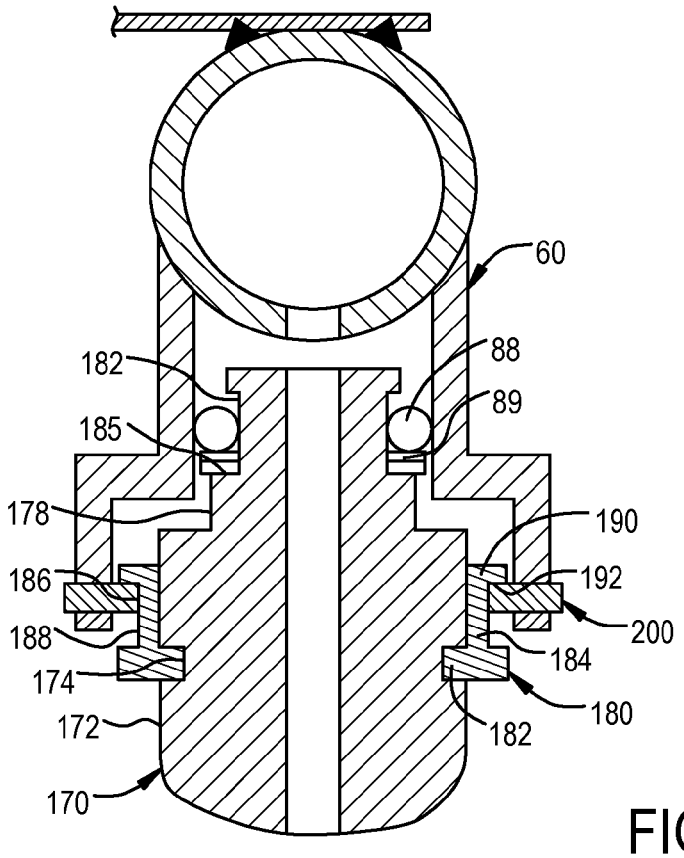
FIG. 5 is a cross-sectional view of a second embodiment of the fuel injector mounting system of the present invention.
Figure 6:
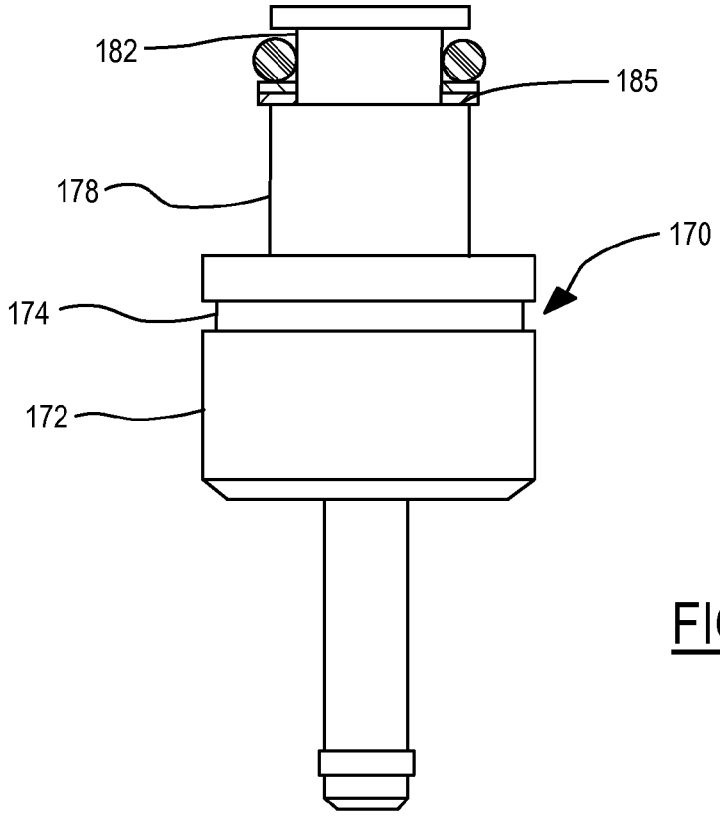
FIG. 6 is a plan view of the fuel injector of FIG. 5.
Figure 7:
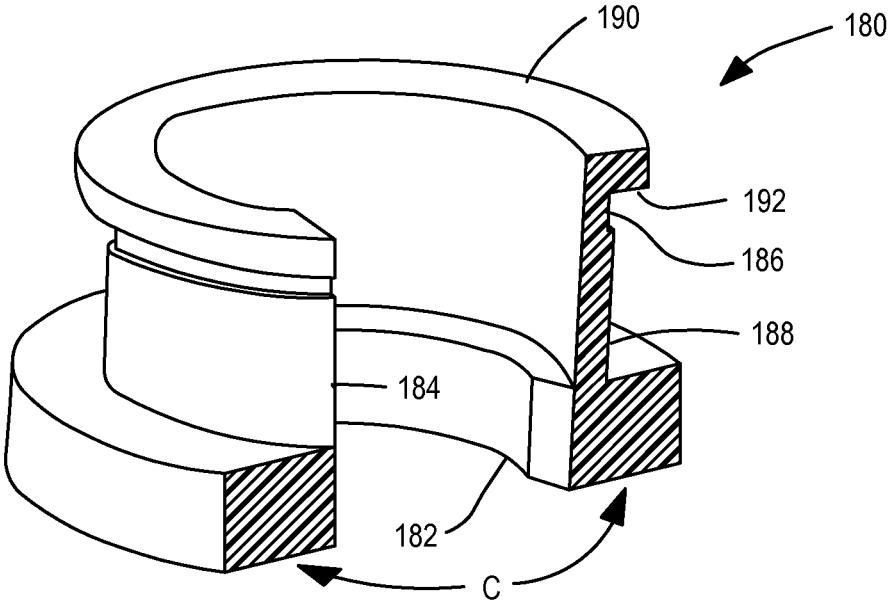
FIG. 7 is a perspective view of the adapter of FIG. 5.

Referring to FIGS. 5, 6, and 7, an alternative fuel injector assembly 170 is supported in fuel rail cap 60. The injector assembly 170 has a cylindrical lower body section 172, a reduced diameter intermediate stepped section 178, and a further reduced diameter upper stepped section 182. An upwardly facing shoulder 185 is formed between the intermediate section 178 and upper section 182 for seating washers 89 and O-ring 88, similar to that of the FIG. 1 embodiment. The lower body section 172 includes a groove 174 which extends approximately 220 degrees around the outer surface of the lower body section 172.

The fuel injector assembly 170 also includes an adapter 180 shown more clearly in FIG. 7. The adapter 180 has a radially inwardly extending lower flange 182 which fits snugly into the injector groove 174 to lock the adapter 180 to the injector 170. The adapter 180 is generally cylindrical and has a "C" shape with a circumferential opening "c" of about 140 degrees. The adapter 180 has an intermediate cylindrical section 184 with an outer surface 188 defining a shallow outer groove 186. The adapter 180 has an upper flange 190 which provides a downwardly facing shoulder 192 bordering the groove 186. The clip 90 of the FIG. 1 embodiment is positioned within the groove 186 to lock the adapter to the fuel rail cap 60 and thereby support the injector 170. The adapter 180 can be used with numerous injector designs with only minor changes to the injector, such as adding an external surface groove such as 174.

The descriptions of specific embodiments of the invention herein are intended to be illustrative and not restrictive. The invention may be practiced otherwise than as specifically explained and illustrated without departing from its spirit or scope as defined by the appended claims.

What is claimed is:

1. A fuel injector assembly comprising:

a fuel injector cap having a wall with an outer surface and an inner surface, the inner wall surface defining an axially extending internal cavity, the outer surface having a transversely extending groove extending partially through the wall, a transversely extending first slot extending from the outer surface to the internal cavity, and a transversely extending second slot extending from the outer surface to the internal cavity, the second slot circumferentially spaced from the first slot, wherein the fuel injector cap groove extends between and adjoins the first and second slots, a fuel injector received within the internal cavity of the fuel injector cap, and a clip having a transversely extending section extending into the fuel injector cap groove, a first leg extending through the fuel injector cap first slot, a second leg extending through the fuel injector cap second slot, the first and second clip legs supporting the fuel injector on the fuel injector cap.

2. The fuel injector assembly of claim 1 wherein the fuel injector includes a flange, wherein the first clip leg engages the flange.

3. The fuel injector assembly of claim 2 wherein the fuel injector cap includes an internal shoulder, and wherein the first clip leg engages the internal shoulder.

4. The fuel injector assembly of claim 1 wherein the fuel injector includes a fuel injector body having a groove, and an adapter having a radially inwardly extending flange extending into the fuel injector body groove, wherein the first clip leg engages the adapter to support the fuel injector.

5. The fuel injector assembly of claim 4 wherein the adapter includes a radially outwardly extending flange engaging the first clip leg.

6. The fuel injector assembly of claim 5 wherein the adapter includes a groove, and wherein the first clip leg extends into the adapter groove.

7. The fuel injector assembly of claim 1 wherein the fuel injector cap wall comprises a generally cylindrical outer surface, and wherein the first and second slots and the cap groove are in the generally cylindrical surface, and wherein the first and second slots and the cap groove extend around the generally cylindrical injector cap surface less than 360 degrees.

8. The fuel injector assembly of claim 7 wherein each of the first and second clip legs has an arcuate radially internal surface, and wherein the clip has an internal notch between the arcuate surfaces.

9. A fuel injector assembly comprising:

a fuel injector cap having a wall with an outer surface and an inner surface, the inner wall surface defining an axially extending internal cavity, the wall having a transversely extending slot extending from the outer surface to the internal cavity, the internal cavity having first and second adjacent and coaxial cylindrical portions, the diameter of the first cylindrical portion being different from the diameter of the second cylindrical portion to provide an internal shoulder, a fuel injector having a cylindrical body and a radially outwardly extending flange having first and second axially spaced surfaces, the first flange surface engaging the internal shoulder, and a clip having a leg extending through the fuel injector cap and engaging the second fuel injector flange surface to clamp the injector flange between the shoulder and the clip to support the fuel injector and restrain axial movement of the fuel injector.

10. A fuel injector assembly comprising:

a fuel injector cap, a fuel injector including a fuel injector body having an external surface, the external surface defining a groove, and an adapter having a flange extending radially inwardly into the fuel injector body groove, the adapter secured to the fuel injector body, the adapter including an external groove, and a clip engaging the adapter groove and the fuel injector cap to support the fuel injector.

11. The fuel injector assembly of claim 10 wherein the fuel adapter extends circumferentially around the fuel injector less than 360 degrees.

12. The fuel injector assembly of claim 1 further comprising:

a fuel rail, a bracket attached to the fuel rail, a fastener attaching the bracket to an engine, and a shock absorber positioned between the bracket and the fastener.

* * * * *